United States Patent [19]

Takai et al.

[11] 4,321,714

[45] Mar. 30, 1982

[54] APPARATUS FOR DEFECATING A URINAL BY MEANS OF FOAM

[75] Inventors: Souichi Takai, Tokyo; Yukinori Watanabe; Kaname Matsumoto, both of Atsugi, all of Japan

[73] Assignee: Nepon Kabushiki Kaisha (NEPON Inc.), Tokyo, Japan

[21] Appl. No.: 114,534

[22] Filed: Jan. 23, 1980

[30] Foreign Application Priority Data

Nov. 22, 1979 [JP] Japan ..... 54-161173[U]
Nov. 22, 1979 [JP] Japan ..... 54-161174[U]

[51] Int. Cl.[3] ..... A47K 11/00; E03D 9/00

[52] U.S. Cl. ..... 4/310; 4/300; 4/301; 4/661; 4/DIG. 5

[58] Field of Search ..... 4/300, 301, 309–311, 4/661, 317, 664, 300.3, 459, 462, 454, 481, 144.1, DIG. 5; 181/233, 234, DIG. 1

[56] References Cited

U.S. PATENT DOCUMENTS

| | | | |
|---|---|---|---|
| 1,114,670 | 10/1914 | Baker | 4/310 |
| 3,383,710 | 5/1968 | Sumner | 4/300 X |
| 3,585,649 | 6/1971 | Miya | 4/300 |
| 3,843,976 | 10/1974 | Miya et al. | 4/661 X |
| 4,170,797 | 10/1979 | Sundberg | 4/317 X |

FOREIGN PATENT DOCUMENTS

| | | | |
|---|---|---|---|
| 330734 | 10/1935 | Italy | 4/310 |
| 766 | of 1897 | United Kingdom | 4/310 |
| 1849 | of 1914 | United Kingdom | 4/310 |
| 518855 | 3/1940 | United Kingdom | 4/310 |

OTHER PUBLICATIONS

"New Crane Light Weight Porcelain Urinal Stalls",-Crane Co. Circular 539 B, Jun. 1920.

*Primary Examiner*—Stuart S. Levy
*Attorney, Agent, or Firm*—Blum, Kaplan, Friedman, Silberman & Beran

[57] ABSTRACT

A method and apparatus for continuously defecating a urinal by means of foam provided on the inside face thereof is provided. Urine odor is sealed in the urinal and hygienically removed immediately after urination and transferred out of the urinal. The urine is sealed and lubricated by the foam, without the need for a large quantity of water.

The urinal is provided with a casing including a foaming tank provided with an air stone and an air delivery pipe therefor, a foam supply pipe connected with the urinal and a water replenishing tank for controlling the level of water within the casing.

4 Claims, 6 Drawing Figures

APPARATUS FOR DEFECATING A URINAL BY MEANS OF FOAM

BACKGROUND OF THE INVENTION

Heretofore, a urinal has been defecated generally by using water.

However, such a system is disadvantageous in that the consumption of water is considerably large, the urine is liable to be splashed, and since the outlet of the urinal is always exposed to the atmosphere, odor prevails thereabout.

SUMMARY OF THE INVENTION

The present invention relates to a method and apparatus for defecating a urinal by means of foam.

The object of the invention is to eliminate the above noted disadvantages, and to provide a foam defecating system for a urinal, wherein a small quantity of surface active agent solution is always supplied as foam, thereby the inside face of the urinal is always defecated by the foam to keep it clean. A larger quantity of foam is continually supplied from openings on both sides of the inside face adjacent to an outlet at the lower portion of the urinal, thereby sealing the outlet with foam to prevent splash at the time of unination, to effect deodorization and to lessen the amount of water for defecating the inside face of the urinal, thus conserving the amount of water used.

BRIEF DESCRIPTION OF THE DRAWING

The present invention will be described in detail with reference to the accompanying drawings showing an embodiment of a urinal of foam defecating system according to the invention, in which.

DESCRIPTION OF THE PREFERRED EMBODIMENTS

Figure 1:
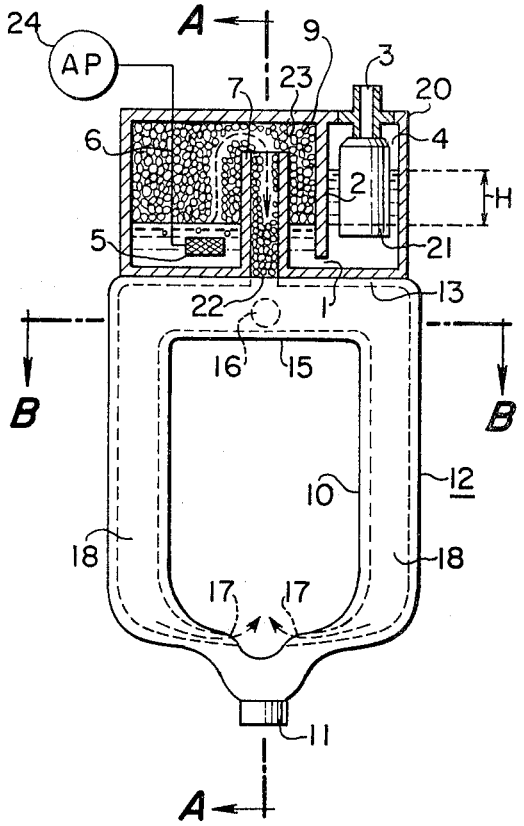
FIG. 1 is an elevational view of a urinal partly in section.
Figure 2:
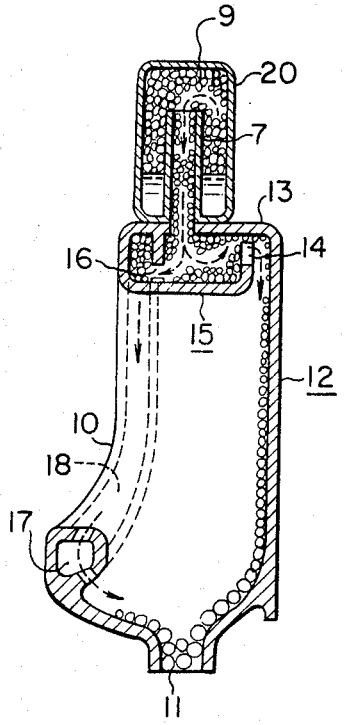
FIG. 2 is a sectional view taken along A—A line of FIG. 1.

In FIG. 1 and FIG. 2, a urinal (12) includes a casing (20) with a partition (2) having a passage (1) at its lower portion to divide casing (20) into a water replenishing tank (4) having a water supply port (3) at its upper portion and a foaming tank (9) for surface active agent provided with an air delivery pipe (6) having an air stone (5) at its lower portion. A foam supply pipe (7) is provided within said tank (9) with its upper end being opened at a required height of an upper space (23). Pipe (7) is connected with a central opening (22) of a top wall (13) of urinal (12) and a foam receiving dish (15) having a plurality of notches (14) on its both side portions and back portion is provided under top wall (13). A foam supply hole (16) provided on the front face of foam receiving dish (15) is connected with upper portion of foam supply passages (18, 18) of foam supply openings (17,17) which are opened at both of inside faces adjacent to an outlet at lower end portion of urinal (12).

Figure 3:
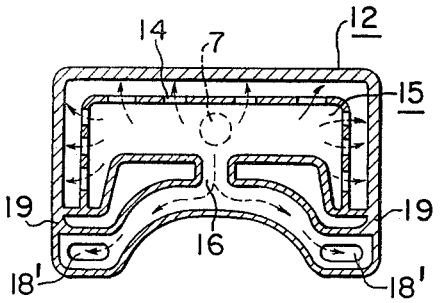
FIG. 3 is a sectional view taken along B—B line of FIG. 1.
Figure 4:
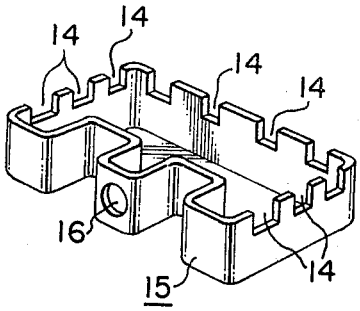
FIG. 4 is a perspective view of a foam receiving dish.

The invention is applicable to conventional urinals of the flash system type; however, it is also applicable to those shown in FIGS. 2–4.

In operation, form descents through the central opening (22) of the top wall of urinal (12) and is supplied to foam receiving dish (15) under top wall (13). A part of the foam overflows from notches (14) cut on both side portions and back portion to flow down along the inside face of urinal (12). Thus, the inside face thereof is continuously defecated by the foam, so that the urinal (12) may be maintained in a clean and hygenic manner. A large part of the foam supplied to foam receiving dish (15) passes from foam supply hole (16) through foam supply passages (18, 18) and is discharged from the foam supply openings (17, 17) opened on both of inside faces adjacent to outlet (11) at the lower end portion of urinal (12) to seal continuously outlet (11) with foam.

Figure 5:
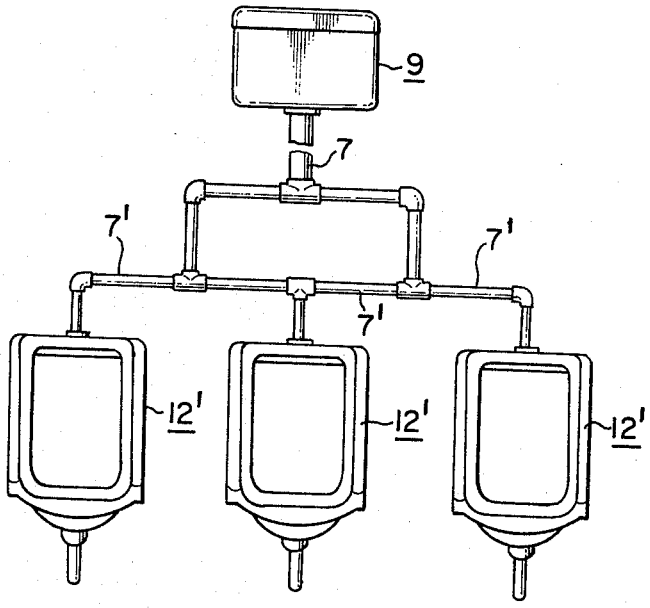
FIG. 5 is an elevational view, showing a state of piping of a foaming tank and a plurality of urinals.
Figure 6:
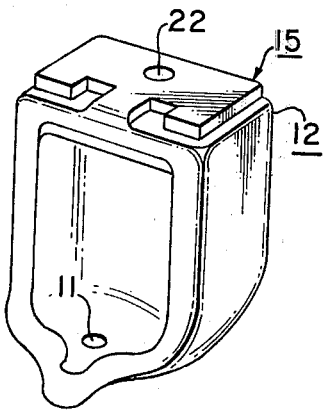
FIG. 6 is a perspective view of a urinal partly cut away.

The apparatus of the invention is constructed as mentioned above, and its foaming tank (9) is provided directly on top wall (13) of urinal (12) as shown in FIG. 1 and FIG. 2. Foaming tank (9) may also be provided on an upper wall face and the like of a toilet room as shown in FIG. 5. In this embodiment foam supply pipe (7) may be connected with a plurality of openings (22) at top walls of respective urinals (12') through foam supply branch pipes (7').

Notches (14, 14) cut on both sides and back of foam receiving dish (15) positioned under top wall (13) of urinal (12) are provided at a required height, namely higher than said foam supply hole (16) as shown in FIG. 2. The width and (or) depth are made smaller, the nearer they are positioned to foam supply pipe (17) connected with top wall (13) of urinal (12) and their width and (or) depth are made larger flows at greater distances from foam supply pipe (17). Thus, the foam flows uniformly down along the inside wall face of urinal (12) from both sides and back portion of foam receiving dish (15).

The water-level of foaming tank (9) is controlled by a water level regulator utilizing a ball tap (21). Water replenishing tank (4) is replenished with city water from water supply port (3); or in replenishing tank (4). Surface active agent is added as a solution of surface active agent from a tank outside of casing (2) through water supply port (3).

Air delivery pipe (6) of foaming tank (9) is connected with an air pump (24). By continuously driving pump 24, the solution of surface active agent within tank (9) is foamed by air bubbles emerging from air stone (5) at the end of air delivery pipe (6) to generate foam. Bubbles pass through foam supply pipe (7) which opens into the upper portion of the foaming tank (9) and is supplied to foam receiving dish (15) under top wall (13) of urinal (12). A part of the foam will overflow from notches (14, 14) cut on both side portions and back portion of foam receiving dish (15) causing foam to flow down along the inside face of urinal (12).

As the inside face of urinal (12) is continuously defecated by the foam, urinal (12) may be kept in a hygenic and clean manner. Since a part of the foam supplied to foam receiving dish (15) passes through foam supply passages (18, 18) from foam supply hole (16) on the front face of foam receiving dish (15) and is discharged from foam supply openings (17, 17) opened on both sides of the inside face adjacent to outlet (11) at the lower portion of urinal (12) to seal continuously outlet (11) with foam, splashing will not take place at the time of urination. Additionally deodorization is effective.

Since water defecation for urinal (12) is required, it is not urinal (12) is well suited for conservation. Consumption of water may be reduced to less than one-tenth compared with conventional urinals using the water flash system. That is to say, in a flash valve of a conventional urinals of the water flash type, 4 to 6 liters of water are consumed at each urination. If such a urinal is used about ten times every day, 40 l to 60 liters of water are consumed per day. In contrast in the urinal of the foam defecating type system according to the present invention, only about 2 to 4 liters of water are used per day. Another characteristic of the invention is that so called "splash" can be completely prevented. This disadvantage cannot be avoided in conventional urinals and there is always some splash leading to an unclean, while in the apparatus according to the invention, the vicinity of the opening above outlet (11) of urinal (12) is always covered with foam so that, splash can be completely prevented.

What is claimed is:

1. A urinal utilizing a foam defecating system having a front face being opened, a top wall, opposed sides and a rear wall, said sides and rear wall having an inside wall face and an outlet at its lower end, comprising; a casing and a foam supply pipe connected between said casing and the central portion of said urinal, a foam receiving dish, having side portions and a back portion including a plurality of notches for passing foam provided under the top wall of the urinal, to permit foam to flow through said notches and down the whole surface of the inside wall face of the urinal, foam supply passages in vertical direction are provided on both sides of the open front face to a position adjacent to the outlet at the lower end of the urinal, a foam supply hole provided on the front face of said foam receiving dish coupled to the upper end portion of said foam supply passages so that foam will flow down the foam supply passages and emerge from the openings of the foam supply passages to seal the outlet of the urinal.

2. The urinal of claim 1, wherein the foam is an aqueous solution of a surface active agent which overflows through the notches for continuously passing foam from said foam receiving dish across the whole surface of the inside wall face of the urinal, whereby the inside wall face thereof is always defecated and kept clean; and, at the same time, by continuously supplying foam from the foam supply openings on both sides of the inside face adjacent to the outlet at the lower end portion of the urinal, the outlet thereof is sealed with foam.

3. The urinal of claim 1, including a plurality of urinals characterized in that said foaming tank is provided at a position considerably higher than urinals on wall surface and the like within a toilet room, and foam supply pipes connected with respective central openings of respective top walls of the plurality of urinals through said foam supply pipes.

4. The urinal of claims 1, 2 or 3, characterized in that the inside of the casing is divided into a water replenishing tank having an upper water supply port and a foaming tank, a partition for said division has a passage at its lower portion, and said foaming tank is provided with an air delivery pipe having an air stone at its lower bottom, as well as a foaming tank, in which an upper end of a foam supply pipe projectingly provided through lower bottom of the foaming tank is opened at a required height of an upper space thereof, is provided on the urinal, and said supply pipe is connected with a central opening of the urinal of which front face is opened and at lower end of which an outlet is provided.

* * * * *